US005337936A

United States Patent [19]

Blum

[11] Patent Number: 5,337,936

[45] Date of Patent: Aug. 16, 1994

[54] CONCEALED BELT-MOUNTED VALUABLES HOLDER

[76] Inventor: Alvin S. Blum, 2350 Del Mar Pl., Fort Lauderdale, Fla. 33301

[21] Appl. No.: 69,746

[22] Filed: Jun. 1, 1993

[51] Int. Cl.[5] ..... A45F 5/00

[52] U.S. Cl. ..... 224/253; 224/229; 224/240

[58] Field of Search ..... 224/222, 224, 225, 226, 224/227, 228, 229, 253, 250, 231, 240, 911, 912; 383/17, 24; 150/107, 134; 190/101, 115; 16/119, 120, 125

[56] References Cited

U.S. PATENT DOCUMENTS

| | | | |
|---|---|---|---|
| 315,303 | 4/1885 | Lambert | 224/253 X |
| 900,096 | 10/1908 | Fisher | 224/228 X |
| 1,273,201 | 7/1918 | Teuber | 224/250 X |
| 2,474,495 | 6/1949 | Pollak | 224/26 |
| 2,908,306 | 10/1959 | Chorost | 150/134 |
| 2,983,412 | 5/1961 | Ferguson | 224/26 |
| 3,118,580 | 1/1964 | Manshel | 224/231 |
| 4,416,315 | 11/1983 | Foley | 150/134 |
| 4,434,921 | 3/1984 | Santhoff | 224/253 |
| 4,771,927 | 9/1988 | Ventura | 224/252 |
| 4,998,653 | 3/1991 | LaBelle | 224/151 |
| 5,082,157 | 1/1992 | Emerson-Santos | 224/226 X |
| 5,082,157 | 1/1992 | Emerson-Santos | 224/229 |
| 5,255,833 | 10/1993 | McAllister | 224/202 |

*Primary Examiner*—Glenn T. Barrett
*Attorney, Agent, or Firm*—Alvin S. Blum

[57] ABSTRACT

A holder for valuables includes a thin flat container body with one or more compartments with an open top edge and a closure flap extending from a back panel and fastening onto a front panel. A pair of elongate narrow strips of material each have a first end secured to the upper portion of the back panel. A second end of each strip terminates in a belt loop for threading onto a belt worn on trousers. The distance between the loop and the container body of each strip is greater than the height of the container body. This permits the container body to be moved between a concealed position behind the trousers and and accessible position in front of the trousers while fastened to the belt without bending the container body or disarranging the clothing. The container body slips past the waistband of the trousers in moving between concealed and access positions without bending the container body or the contents thereof making it suitable for storing passports, credit cards and the like.

14 Claims, 1 Drawing Sheet

CONCEALED BELT-MOUNTED VALUABLES HOLDER

FIELD OF THE INVENTION

This invention relates to concealable holders for valuables carried by a person and more particularly to a holder for money, passports, credit cards and the like that is mounted on the belt of the trousers that can be concealed behind the clothing.

BACKGROUND OF THE INVENTION

Money belts are well known. They consist of a closable holder with one or more compartments. They are generally elongate with a belt portion at opposed short ends for wearing around the waist beneath the clothing. This provides a very secure location, not visible to passersby. However, the belt directly against the body may be uncomfortable. Furthermore, access is extremely awkward.

More accessible are the pouches that mount directly onto the belt that supports the trousers. These advertise to the passerby exactly where to go for the valuables, so they may be an invitation to crime against the person and property. Furthermore, they bulge outward from the trousers, giving an unattractive appearance.

SUMMARY OF THE INVENTION

It is, accordingly, an object of the invention to provide a holder for valuables that is concealed under the clothing for security and enhanced appearance. It is another object that the holder be readily moved to a position outside of the clothing for ready access to the contents without disarranging the clothing. It is yet another object that the holder be held on the belt of the user to reduce the cost and the awkwardness of a second belt. It is yet another object to provide a thin flat holder that moves or hangs loose behind the trousers to reduce discomfort and be substantially unnoticeable when in concealed position.

The holder of the invention comprises a thin flat pouch or purse with one or more compartments and a closing flap with fastener. Extending upward from the pouch are two elongate strips, spaced apart substantially by the width of the pouch. Each strip terminates in a loop large enough to freely receive the belt. The strips are longer than the height of the pouch. This is necessary for enhanced movement between concealed and access positions without bending the pouch itself. When the pouch contains a passport or credit cards, bending the pouch would be undesirable.

These and other objects, advantages and features of the invention will become more apparent when the detailed description is considered in conjunction with the drawings.

DETAILED DESCRIPTION OF PREFERRED EMBODIMENTS

Figures 1, 2, 3, 4, 5, 6, 7, 8, 9, 10, 11, 12:
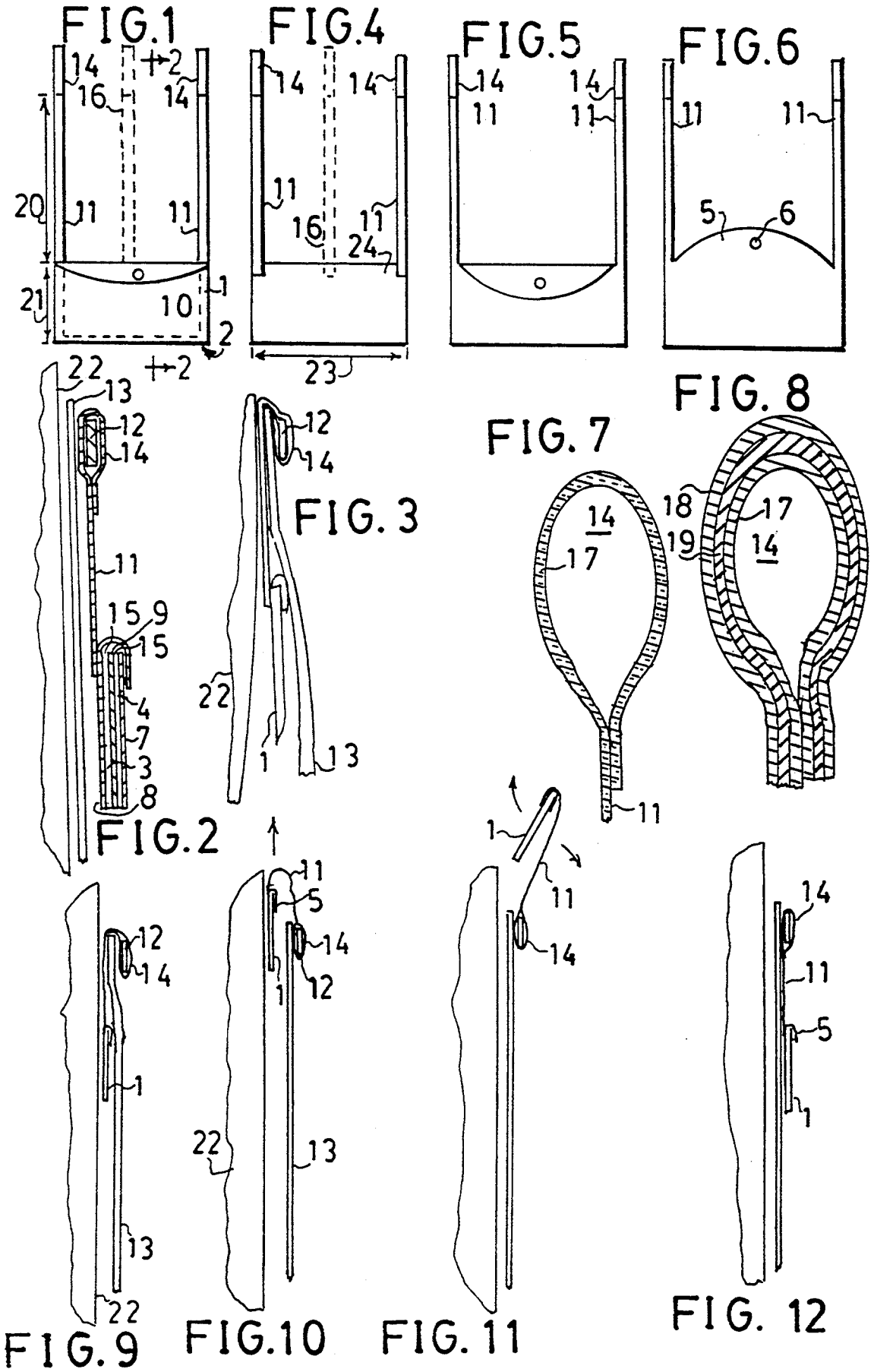
FIG. 1 is a front elevation view of a holder of the invention.
FIG. 2 is a sectional view taken through line 2—2 of FIG. 1.
FIG. 3 is a side elevation view of the holder of FIG. 1.
FIG. 4 is a rear elevation view of the holder of FIG. 1.
FIG. 5 is a front elevation view of an alternative embodiment of the invention.
FIG. 6 is a rear elevation view of the holder of FIG. 5 with cover flap open.
FIG. 7 is a sectional detail view of a loop of transparent material.
FIG. 8 is a sectional detail view of a loop with a reinforcing wire.
FIG. 9 is a diagrammatic view of the device in the concealed mode of operation.
FIG. 10 is a diagrammatic view of the device being lifted up from the concealed mode.
FIG. 11 is a diagrammatic view of the device having been rotated 180° about the strips.
FIG. 12 is a diagrammatic view of the device having been rotated around the belt another 180° to the access position.

Referring now first to FIGS. 1–4, the holder 2 of the invention comprises a thin flat container body 1 with two compartments 3, 4 closed with a flap 5 secured by a fastener such as the snap 6, hook and loop or other fastener well known in the art. The body 1 has a front piece or panel 7, a rear piece or panel 8 and a partition 9 joined together on three sides by stitching 10, cement heat sealing or other means well known in the art. This arrangement leaves the upper edges 15 open to provide access to the two compartments 3, 4, thus formed. The flap 5 is an extension of the rear panel 8. Connected to the rear panel are two spaced apart strips 11 which terminate in loops 14. These loops 14 are large enough to freely receive the belt 12 that holds up the user's trousers 13. These strips or straps are narrow enough that they look like the belt loops on trousers and the loops found on many belts. Consequently, the passerby would not notice anything suggesting concealed valuables, when the container body 1 is behind the trousers, because only these loops 14 will be visible. Generally the user's body is thickest at the waist, so that the holder lands in a free space between the leg and the trouser without bulging. By spacing the straps apart by at least the vertical height of the holder the holder resists twisting and the loop spacing is more consistent with the usual clothing appearance. Alternatively, additional straps such as strap 16 of FIG. 4 may be provided. The straps are shown stitched to the back panel 8 at its upper portion 24.

Alternatively, as shown in FIGS. 5 and 6, the straps 14 may be an integral extension of the rear panel 8. The device may be made of a variety of sheet materials such as leather, fabric or plastic. When made of transparent plastic, the device may be even less visible. FIG. 7 is a sectional view in detail of a loop 14 made of a single layer 17 of transparent sheet material. FIG. 8 shows a sectional view of a detail of a loop 14 made up of a double layer of sheet material 17, 18 with s thin steel cable sandwiched therebetween for for further security against cutpurses. Because the holder may be used for plastic credit cards, passports, and other non-foldable items, the free length of the strap 20 should be greater than the vertical height 21 of the holder body to facilitate movement between concealed and accessible positions without undue discomfort.

This is best shown in the diagrams of FIGS. 9–12, in which the container body first hangs between the leg 22 and the trouser 13, concealed with only the loop 14 showing (FIG. 9). The body 1 is lifted out of the concealed mode by either lifting up on the straps or slipping a hand behind the trousers, grasping the body 1 and lifting it upwards. Because the holder is thin and flat, it is easily lifted straight up behind the belt, but the strap length 20 must be great enough so that the container body 1 clears the waistband of the trousers (FIG. 10) with the container body 1 parallel to the trousers. If it were shorter, the user would have to either bend the container body 1 or provide an uncomfortably large gap behind the belt. Credit cards and passports are not readily bendable. When the container body 1 is above the waistband 23 of the trousers, it may then be rotated (FIG. 11) and swung downward to the access position (FIG. 12). In this position, the contents of the compartments are conveniently accessible by simply opening the flap 5. If the holder must be released because both hands are busy, there is no danger that it will be dropped or left behind because it is firmly attached to the user. Container body 1 has a width 23 greater than its vertical height 21 so that it may hold elongate articles such as passports while presenting a minimal vertical height for enhanced operation and for spacing the loops 14 farther apart for better simulation of ordinary spacing apart of belt loops.

The above disclosed invention has a number of particular features which should preferably be employed in combination although each is useful separately without departure from the scope of the invention. While t have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A holder for valuables for mounting on a belt of a user's trousers comprising:

a back panel;

at least one intermediate panel;

a front panel secured at three edges thereof to said back panel and said at least one intermediate panel to form a thin flat container body having a width and a height and at least two compartments open at an upper edge for access thereto;

a closure flap connected to said back panel arranged for removably fastening to said front panel and thereby closing said compartments;

two elongate, narrow strips of material, each said strip having a first end secured to said back panel at an upper portion thereof and a second end terminating in a loop, said loop arranged for passing a trouser belt therethrough, said strips being spaced apart from one another on said back panel by a spacing distance at least equal to the height of said container body, each said strip having a distance between said loop and said back panel greater than said height of said container body to thereby permit facile movement of said container body between a concealed position underneath a wearer's trousers and an accessible position outside said trousers while said loops are engaged by a belt on said trousers without bending said container body.

2. The holder according to claim 1, in which said spacing distance is substantially the width of said container body.

3. The holder according to claim 1, in which said container body has a width greater than the height thereof.

4. The holder according to claim 1, further comprising a third said elongate, narrow strip of material bearing a belt loop, located intermediate said two elongate, narrow strips of material.

5. A holder for valuables mountable on a belt of a user's trousers, said holder comprising:

a back panel;

a front panel secured at three edges thereof to said back panel to form a thin flat container body having a width that is greater than the height thereof and providing at least one compartment open at an upper edge;

a closure means removably closing said upper edge;

two elongate narrow strips of material, each said strip having a first end secured to said back panel at an upper portion thereof and said strip having a second end terminating in a loop, said loop arranged for passing therethrough a trouser belt, said strips being spaced apart from one another on said back panel by a spacing distance at least as great as the height of said container body, each said strip having a distance between said loop and said back panel greater than said height of said container body to thereby permit facile movement of said container body between a concealed position underneath said trousers and an accessible position outside said trousers while said loops are engaged by a belt on said trousers without bending said container body.

6. The holder according to claim 5, in which said spacing distance is substantially the width of the container body.

7. The holder according to claim 5, in which said loops are reinforced by a metal cable.

8. The holder according to claim 5, in which said loops are made of a transparent material.

9. The holder according to claim 5, in which a third said elongate, narrow strip of material bearing a belt loop, is located intermediate said two elongate, narrow strips of material.

10. The holder according to claim 5, in which said container body is provided with two compartments.

11. A holder for valuables mountable on a belt of a user's trousers or skirt, said holder comprising:

a back panel;

a front panel secured at three edges thereof to said back panel to form a thin flat container body having a width that is greater than the height thereof and providing at least one compartment open at an upper edge;

a closure means removably closing said upper edge;

two elongate narrow strips of material, each said strip having a first end secured to said back panel at an upper portion thereof and said strip having a second end terminating in a loop, said loop arranged for passing therethrough a belt, said strips being spaced apart from one another on said back panel by a spacing distance at least as great as the height of said container body, each said strip having a distance between said loop and said back panel greater than said height of said container body to thereby permit facile movement of said container body, without bending thereof, between a concealed position underneath said trousers and an accessible position outside said trousers while said loops are engaged by a belt on said trousers.

12. The holder according to claim 11, in which said spacing distance is substantially the width of the container body.

13. The holder according to claim 11, in which said loops are reinforced by a metal cable.

14. The holder according to claim 11, in which said loops are made of a transparent material.

* * * * *